United States Patent [19]

Burris

[11] 4,454,792

[45] Jun. 19, 1984

[54] EXTENDING BAR STAKE PULLER

[76] Inventor: Wesley E. Burris, P.O. Box 245, Socorro, N. Mex. 87801

[21] Appl. No.: 434,571

[22] Filed: Dec. 16, 1982

[51] Int. Cl.[3] ..... B25B 19/00

[52] U.S. Cl. ..... 81/463; 29/254

[58] Field of Search ..... 81/463; 29/275, 254; 173/90, 91

[56] References Cited

U.S. PATENT DOCUMENTS

| | | | |
|---|---|---|---|
| 1,873,294 | 8/1932 | Cosgrove | 29/254 |
| 1,903,548 | 4/1933 | Kreis | 29/254 |
| 3,050,095 | 8/1962 | Prather | 173/91 |
| 3,106,012 | 10/1963 | Comer | 29/254 |
| 3,280,455 | 10/1966 | Smith | 29/254 |
| 3,757,409 | 9/1973 | Flanigan | 29/254 |

*Primary Examiner*—James L. Jones, Jr.
*Attorney, Agent, or Firm*—Walter R. Keller

[57] ABSTRACT

A hand tool for pulling tent stakes, trap stakes, or driven anchors comprising a claw foot having a standing bar, and a sliding bar with a handle, wherein the standing bar and the sliding bar are slideably engaged to each other by a slide impact lug affixed to the standing bar and a running impact lug affixed to the sliding bar. The tool, a stake puller, being lightweight and operable with one hand, uses the sliding hammer principle.

3 Claims, 1 Drawing Figure

EXTENDING BAR STAKE PULLER

BACKGROUND

1. Field of the Invention

This invention relates primarily to hand-held tools and more specifically to impact tools for removing stakes, anchors, pegs and the like used in securing such items as traps and tents.

2. Description of the Prior Art

In the past, the most common method of removing stakes, tent pegs, and trap stakes has been to loosen them with transverse blows, the struggling in a back-breaking position, bent over, and finally pulling them out. KREIS, U.S. Pat. No. 1,903,548 teaches a slide hammer with a claw foot, having a sleeve-like hammer slidingly mounted on a rod. Other impact tools for special uses similarly use a hammer or weight sliding on a rod. SMITH, U.S. Pat. No. 3,280,455 teaches an axle puller with a handle; COSGROVE, U.S. Pat. No. 1,873,294 teaches a puller for automobile axles; and FLANIGAN, U.S. Pat. No. 3,757,409 teaches a tool which is adapted for removing and inserting a coal bit in a ripper machine. All of the foregoing inventions use a hand-held weight which is slid on a rod, said weight impacting on a shoulder or stop. In all of the foregoing the very real likelihood of pinching or mashing a hand, finger or skin of the hand of the operator between the weight and the shoulder exists and has frequently occurred. In addition, the operator must slide the weight from the vicinity of the tool end toward the handle, requiring the operator to stoop, kneel, or otherwise place his body near the tool end. Further, the aforementioned inventions require the use of two hands; one for steadying the tool, and the other hand for sliding the weight.

SUMMARY

The present invention relates to impact tools, specifically to slide hammers. However, unlike prior slide hammers, this invention does not use a heavy slide weight simply sliding on a rod. Because it is designed for use as a stake puller, the stakes being used to secure tents, and traps and the like, it is desireable to keep the weight of the tool to a minimum. Campers, hikers, and trappers do a lot of walking and strongly reject the idea of carrying a lead weight in the field.

It is therefore an object of this invention to provide a lightweight impact stake puller for use in the field. Further it is an object of this invention to eliminate the necessity for bending or stooping to pull stakes. An additional objective is to provide a tool which eliminates the possibility of painful injury due to mashing a finger or the skin of the user; and to provide a tool capable of being operated with one hand, for those persons who only have one hand or arm; or so that for those persons with two hands, one hand is free to carry other articles. Finally, an objective of this invention is to provide a tool which is inexpensive, and within the modest means of the intended users.

DESCRIPTION OF THE PREFERRED EMBODIMENT

Figure 1:
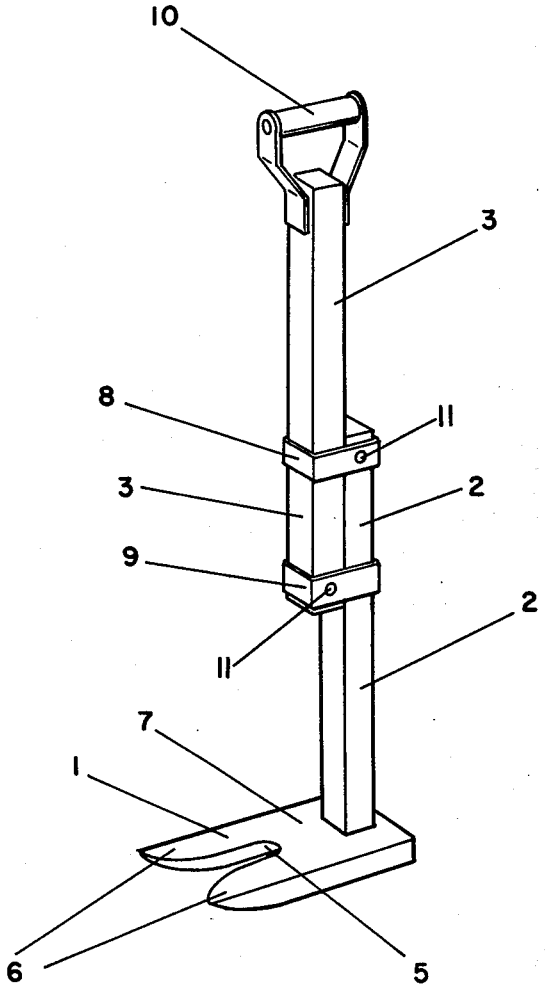
FIG. 1 is an isometric view of the invention.

Referring to the drawing, FIG. 1 shows the invention to have a foot 1, a standing bar 2, a slide bar 3, and a handle 4. The foot 1 is shaped similar to a claw hammer, having a top 7, a notch 5, and two claws 6. Adjacent to the end of the foot opposite the claws 6, and on the top 7, the standing bar 2 is rigidly affixed, such as by welding. The standing bar 2 is depicted as being an elongated member having a square, tubular cross section; however any cross section could be used. Ease of manufacture dictates that square tubular stock is desireable for the standing bar 2 and the slide bar 3 as will be discussed hereinafter.

Rigidly affixed to the free end of the standing bar 2 is a slide impact lug 8. The slide impact lug 8 is affixed to the standing bar as by rivet 11 or as by a weldment; and the slide impact lug 8 is shaped and sized to form an aperture and to slideably accept within said aperture the slide bar 3 adjacent to the standing bar 2.

The slide bar 3 has the handle 4 rigidly affixed on one end as by welding; and the remaining free end of the slide bar 3 is inserted through the slide impact lug 8. The remaining free end of the slide bar 3 has affixed thereto a running impact lug 9. The running impact lug 9 is rigidly affixed to the slide bar 3 as by rivet 11 or as by a weldment; and the running impact lug 9 is shaped and sized to slideably surround the standing bar 2. The slide bar 3 can be of any cross section, but is depicted as square tubular, and of the same dimensions as the standing bar 2. The slide bar 3 is oriented, when inserted into the slide impact lug 8 so that the plane of the handle 4 parallels the direction of the claws 6. No torque about the longitudinal axis of the standing bar 2 or the sliding bar 3 is desired, nor anticipated, except for inadvertant torques applied during use. However it is desireable to maintain the orientation of the handle 4 with respect to the claws 6. Consequently, the square tubular cross section of the standing bar 2 and the sliding bar 3, combined with the square apertures formed by the slide impact lug 8 and the running impact lug 9 maintain the desired orientation of the handle 4 and the claws 6. In this configuration, the slide impact lug 8 and the running impact lug 9 can be identical, but installed on different bars thus simplifying manufacture.

The handle 4 is shown as having a durable, but cushioning grip 10. The grip may be made of any slightly resilient material, but rubber will work very satisfactorily. Such a grip may be installed before or after the handle 4 is installed on the slide bar 3; and the purpose of the grip 10 is to cushion the impact on the user's hand.

The user, in operating the invention, grasps the handle 4 and allows the foot 1 to slide toward the ground. The claws 6 then are engaged to a stake, not shown. The handle 4 is then slid toward the foot 1, then snatched rapidly away from the foot 1 and rotated slightly toward the user. As the slide bar 3 moves away from the foot 1, the running lug 9 approaches the slide impact lug 8. When the handle 4 is fully extended, the running impact lug 9 impacts on the slide impact lug 8, and the slight rotation of the handle 4 provides a lever arm through which the impact force is transmitted through the foot 1 to the stake. It is important to notice that the operation of the invention requires only one hand, because the orientation of the invention is maintained by the user's hand grasping the handle 4. The user's other hand is free to carry other articles and is not in a position to be pinched. While weight is minimized by the tubular cross section of the standing bar 2 and the slide bar 3, sufficient impact force can be generated by increased velocity of the slide bar 3.

I claim:

1. An extending bar stake puller, comprising a foot, having claws, and a standing bar rigidly affixed at one end to the top of the foot, and an impact lug rigidly affixed to the free end of the standing bar; said impact lug being sized and shaped to form an aperture and slideably accept a slide bar therein adjacent to the standing bar, and the slide bar, and a handle rigidly affixed to one end of the slide bar, and said slide bar being inserted into the aperture formed by the impact lug in a manner such that the plane of the handle is parallel to the direction of the claws on the foot, and a running impact lug rigidly affixed to the free end of the slide bar, said running impact lug being sized and shaped to slideably surround the standing bar.

2. The invention of claim 1 wherein the standing bar and the slide bar are made of material having a square tubular cross section.

3. The invention of claim 1 having in addition a cushion grip enclosing the handle.

* * * * *